United States Patent [19]

Sjöberg

[11] 4,263,470

[45] Apr. 21, 1981

[54] HOLDING DEVICE FOR ELECTRICAL RESISTANCE ELEMENTS IN FURNACES

[75] Inventor: Nils G. Sjöberg, Hallstahammar, Sweden

[73] Assignee: Bulten-Kanthal AB, Hallstahammar, Sweden

[21] Appl. No.: 60,703

[22] Filed: Jul. 25, 1979

[30] Foreign Application Priority Data

Aug. 30, 1978 [SE] Sweden ..... 7809151

[51] Int. Cl.[3] ..... H05B 3/06

[52] U.S. Cl. ..... 13/25; 338/317

[58] Field of Search ..... 13/25; 338/317, 318, 338/290

[56] References Cited

U.S. PATENT DOCUMENTS

| | | | |
|---|---|---|---|
| 3,607,475 | 9/1971 | Schrewelius | 13/25 |
| 3,729,570 | 4/1973 | Beck | 13/25 |
| 3,985,946 | 10/1976 | Werych | 13/25 |

*Primary Examiner*—Roy N. Envall, Jr.

*Attorney, Agent, or Firm*—Pollock, Vande Sande & Priddy

[57] ABSTRACT

A holding device for electrical resistance elements (1) to be suspended in lead-through bricks (6) in furnaces. The holder (7) is connectable to and braceable towards the lead-through brick by means of an anchoring member (14), secured to the lead-through brick, and a fastening member (13), secured to the holder. At least one of these members (13, 14) is movably mounted so as to permit adjustment of the anchoring device prior to the fastening of the holder to the lead-through brick.

12 Claims, 4 Drawing Figures

HOLDING DEVICE FOR ELECTRICAL RESISTANCE ELEMENTS IN FURNACES

BACKGROUND OF THE INVENTION

The invention relates to a holding device for electrical resistance elements to be mounted hanging in lead-through bricks in furnaces, comprising a holder provided with two opposite holding jaws for securing the terminal portions of the resistance elements, said portions being passed through corresponding holes in the lead-through brick.

Various types of such holding devices are known in the art. The mounting is usually performed by first passing the terminals of the resistance element through the holes of the lead-through brick, and thereafter setting the opposite holding jaws against the terminals, so that the latter are kept firmly in the holder, and the resistance element is given a predetermined position relative to the lead-through brick by sliding the terminal portions back into their holes until the holders rest directly on the lead-through brick. If necessary, sealing material, possible packings or the like can be inserted into the clearance between the terminal portions and the corresponding holes. The complete assembly consisting of the lead-through brick and the resistance elements is thereafter introduced into a hole of the furnace roof. Of course, before operation is begun terminal contacts must also be fitted onto the terminal portions of the resistance element so that the latter can be connected to a current source.

While this type of holding device has turned out to operate satisfactorily for several years, certain disadvantages have appeared, particularly in connection with the replacement of resistance elements. Thus, when the furnace is hot (i.e., a furnace temperature exceeding 1000° C., particularly 1300°-1500° C.), it is very difficult to lift the assembly of resistance elements and lead-through brick, since the working conditions on the hot furnace roof are extremely severe. Under such circumstances, it has usually been necessary to pull out a damaged resistance element through the hole of the lead-through brick, causing still further damage to the U-shaped or coil-shaped heating zone of the element when the terminal portions are pulled up through the holes of the lead-through brick. Furthermore, resistance material of this kind (particularly containing substantially $MoSi_2$) becomes very brittle during the cooling phase, which makes handling even more difficult. To lift resistance elements and lead-through bricks simultaneously has proved to be impossible under these severe temperature conditions.

SUMMARY OF THE INVENTION

The object of the invention is to eliminate the above-mentioned disadvantages and, thus, to achieve a rather simple holding device permit rapid and simple mounting of resistance elements without difficulties mentioned above. This is accomplished by a holding device, which is connectable to and braceable towards the lead-through brick by means of an anchoring device comprising an anchor member secured to the lead-through brick and a fastening member secured to holding jaws, the anchor and fastening members being removably connectable to each other, and at least one of these members being movably mounted so as to permit adjustment of anchoring device prior to the fastening of the holder to the lead-through brick. Suitable embodiments and further developments as well as the advantages involved will be apparent from the description which follows.

BRIEF DESCRIPTION OF THE DRAWINGS

In order that the invention may be more clearly understood, reference will now be made to the accompanying drawings, wherein several embodiments of the invention are shown for purposes of illustration, and wherein.

DESCRIPTION OF PREFERRED EMBODIMENTS

Figure 1:
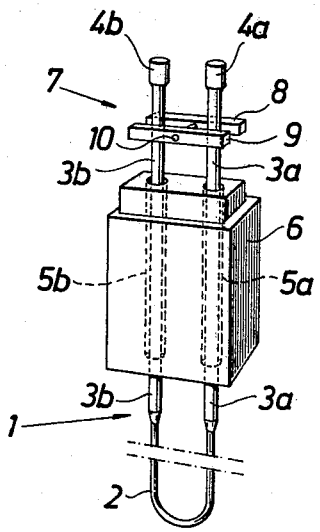
Fig. 1 PRIOR ART
FIG. 1 is a perspective view of a resistance element mounted in a lead-through brick by means of a prior art holding device.

In FIG. 1 there is schematically shown an essentially U-shaped resistance element 1 having two legs and comprising a heating zone 2 bent to U-shape and two thicker terminals 3*a*, 3*b*, the latter being at their free ends 4*a*, 4*b* somewhat wider and metallized so as to enable the fastening of terminal contacts, such as wound ribbons of Al-wire (not shown) so that the resistance elements can be connected to a current source (not shown). The terminals 3*a*, 3*b* are led through corresponding holes 5*a*, 5*b* in a lead-through brick 6. In order to avoid mechanical stress in the resistance element material as far as possible, the holes 5*a*, 5*b* are exactly parallel to each other and to the sides of the brick, and have a diameter somewhat larger than that of the terminals 3*a*, 3*b*. A holder 7 consisting of two opposite holding jaws 8, 9 and a screw 10 connecting the same is mounted on the free terminals 3*a*, 3*b*, so that the latter are fixed relative to each other, and when the resistance element is brought down through the insulating brick, it is supported by the latter by means of the holder 7. Thus, the entire assembly 1, 6, 7 can be inserted into a corresponding hole in the roof of the furnace (not shown), so that the lead-through brick 6 rests on a shoulder in said hole.

As already mentioned, this prior art device has considerable drawbacks, particularly in connection with the replacement of damaged resistance elements.

Figure 2:
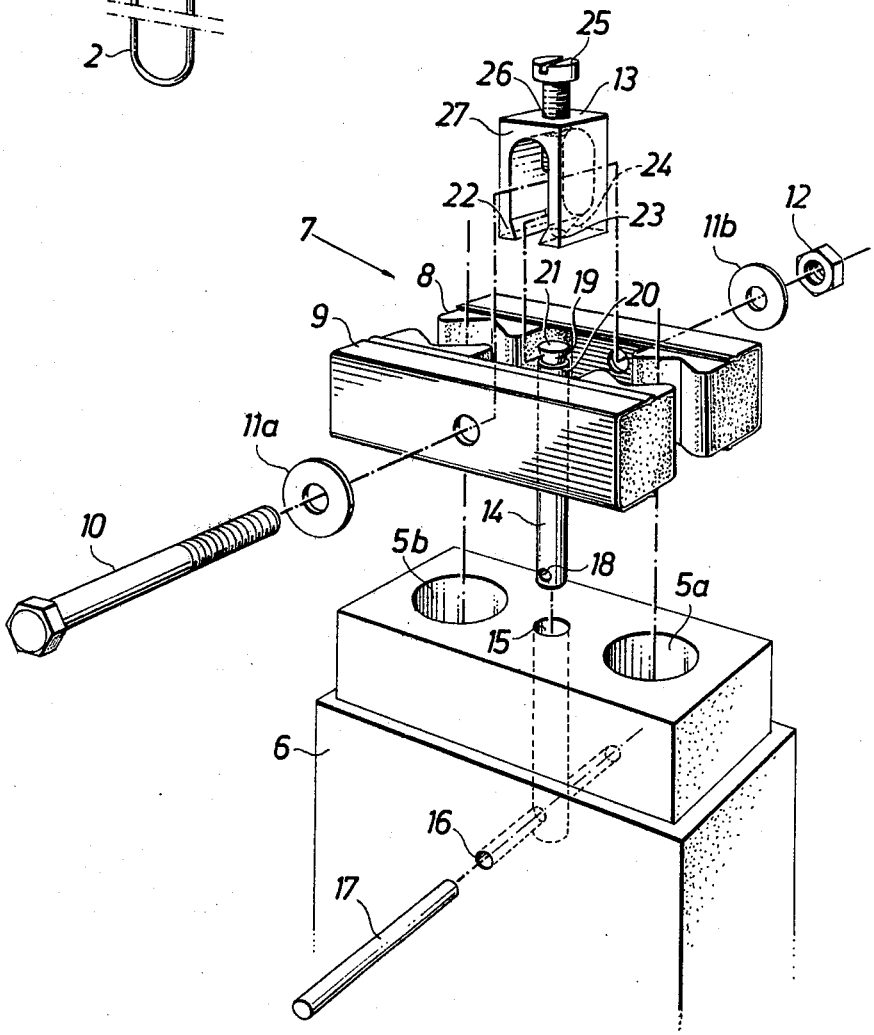
FIG. 2 is an exploded perspective view of a holding device according to the present invention.

According to the invention, an improved holding device is now proposed, a first embodiment of which is shown in FIG. 2, which corresponds to the upper part of FIG. 1 (but in a larger scale and without the terminals 3*a*, 3*b*). The holding device comprises, as in FIG. 1, a holder 7 having two opposite holding jaws 8, 9 and a screw 10, washers 11*a*, 11*b* and a nut 12, whereby the holding jaws can be clamped against the non-illustrated terminals 3*a*, 3*b*. The holder 7 is, however, connectable to and braceable towards the lead-through brick 6 by means of an anchoring device comprising a yoke 13 fitted onto the screw 10 and an anchor pin 14 connectable to the yoke 13, the lower part of the pin being secured in a central bottom hole 15 in the lead-through brick 6 by means of a transverse locking pin 17, which has been inserted through a hole 16 and fitted into a through hole 18 at the lower end of the pin 14. The bottom hole 15 is slightly wider than the anchor pin 14, and the latter can therefore pivot slightly about the locking pin 17. At its upper part, the pin 14 has a circumferential recess portion 19 obtained by turning and forming a collar 20 and a conically widened head 21 adjacent thereto. Said head 21 is dimensioned in such a way that it fits between the free ends 22, 23 of the legs of the yoke 13 upon introducing it sideways into the yoke, the lower parts of the yoke legs having oblique surfaces, the inclination of which corresponds to the cone angle of the head 21. Thus, in the introduced position, the yoke 13 and the anchor pin 14 are axially locked, and the head 21 is partly supported by the oblique surfaces of the yoke 13, and partly by a rear portion 24 (indicated by dashed lines in FIG. 2), the lower part of which connects the leg ends 22, 23 to each other.

When mounting the device, the connecting screw 10 of the holding /jaws 8, 9 is first inserted through the closed yoke 13, while the anchor pin 14 is anchored in the lead-through brick 6 by means of the locking pin 17. In this position, the holder 7 is completely free from the lead-through brick 6, and the terminals 3*a*, 3*b* of the resistance element can be inserted through the holes 5*a*, 5*b* of the lead-through brick 6 and fixed relative to each other in the holder 7 in the same way as described above in connection with FIG. 1.

Before the brick 6 is inserted into the corresponding hole of the furnace roof, the holder 7 (and thus the resistance element as well) is fastened to the lead-through brick 6 by means of the anchoring device 13, 14. Now, it is advantageous that the yoke 13 is displaceable along and pivotable about the connecting screw 10 and that the anchor pin can be swung somewhat about the locking pin 17 for adjustment to a desired position before fastening of the device is effected by screwing down a clamp screw 25, which is engaged in a threaded hole 26 in the straddle portion 27 of the yoke 13, and which abuts the shaft portion of the connecting screw 10. Thus, when the head 21 of the anchor pin 14 has been fitted between the leg ends 22, 23 of the yoke (without any mechanical stress in the resistance element terminals 3*a*, 3*b*, since the parts 13 and 14 are mounted adjustably) and the clamp screw 25 has thereafter been screwed down onto the connecting screw 10, the head 21 is locked in its inserted position between the underside of the connecting screw and the oblique surfaces of the yoke leg ends. When the holder 7 is fastened to the brick 6 the connection between the two parts 13, 14 of the anchoring device is thus secured at the same time. Prior to the fastening operation, special sealing devices or material can of course be inserted between the holder 7 and the lead-through brick 6.

By means of the holder and anchoring device described above, the resistance element 1 will be fastened effectively to the lead-through brick 6, and when replacing a damaged element 1 the whole assembly can be lifted in one operation, e.g., by means of a lifting hook which is hooked to the holder 7, preferably in its connecting screw 10.

Figure 3:
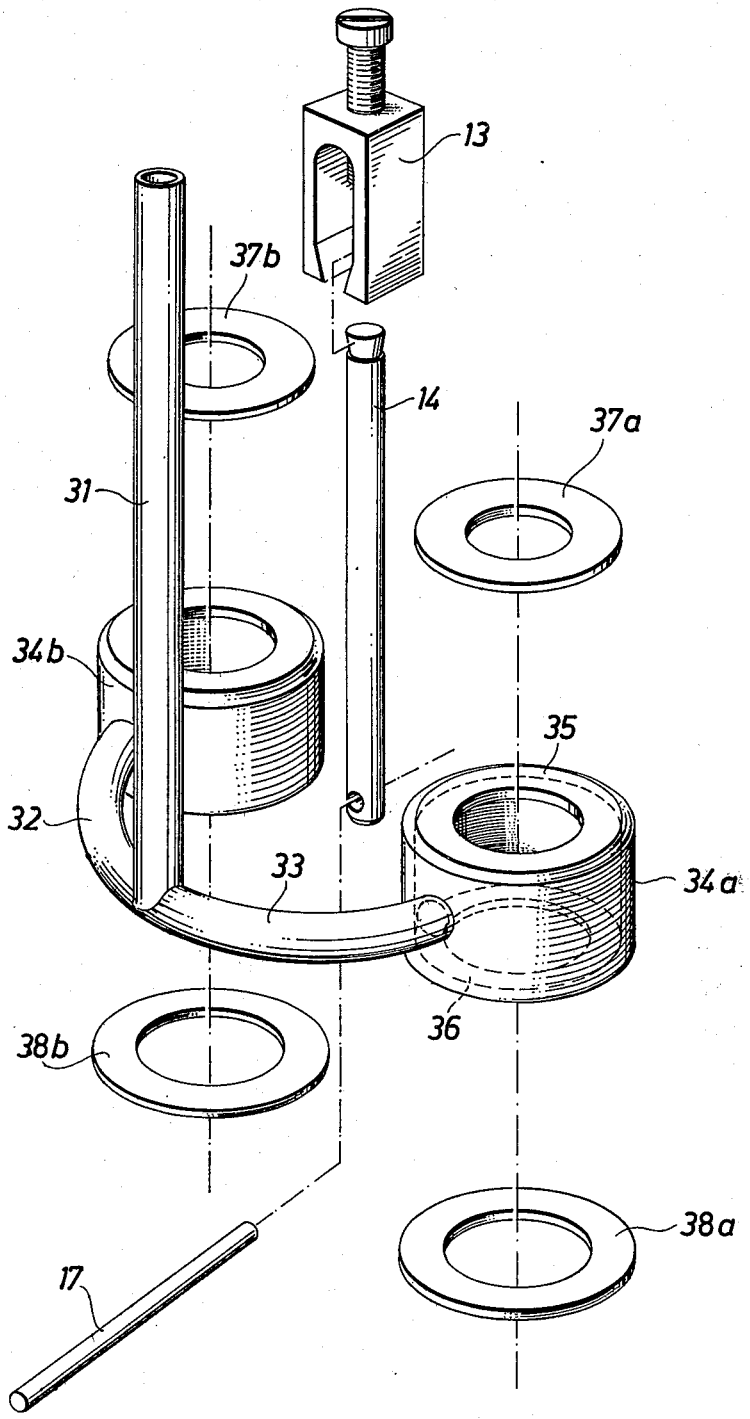
FIG. 3 shows in a view corresponding to FIG. 2 the essential parts included in a second embodiment of the invention.

FIG. 3 illustrates a second embodiment of the invention, wherein the resistance element 1, the lead-through brick 6 as well as the holder 7 have all been omitted. These parts correspond to those shown in FIGS. 1 and 2. In this embodiment the tensile force exerted by the anchoring device 13, 14 is utilized for sealing an air supply device, which comprises an air source and coupling means (not shown), a branched air feed conduit 31–33 and air nozzles 34*a*, 34*b* connected thereto. These nozzles are formed by cylindrical sleeves having upper and lower annular flanges 35 and 36, respectively, and are fitted on the terminals 3*a*, and 3*b*, respectively, together with upper and lower annular gaskets 37*a*, 37*b* and 38*a*, 38*b*, respectively, corresponding to the flanges 35 and 36. The sleeves 34*a*, 34*b* are thus clamped as spacing elements between the holder 7 and the lead-through brick 6 while sealing at the top and the bottom by means of the annular gaskets 37*a,b* and 38*a,b* , so that air can be blown into the clearance between each terminal 3*a*, 3*b* and the wall of the corresponding hole 5*a*, 5*b* in the lead-through brick in order to cool the terminals (which may be required when starting the furnace) or to prevent steam or pollution from entering the lead-through holes from below.

Figure 4:
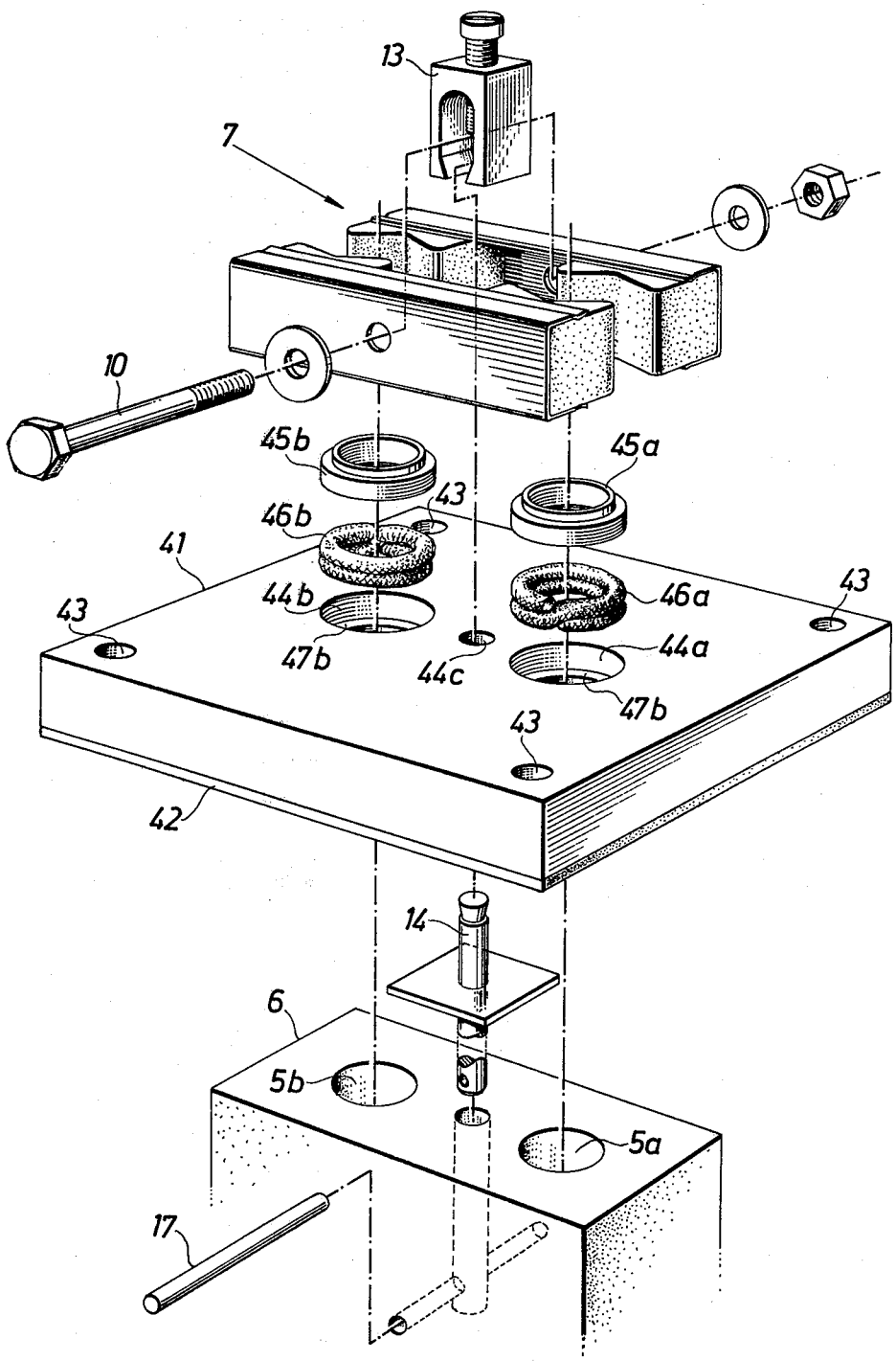
FIG. 4 shows a view corresponding to FIGS. 2 and 3 the essential parts included in a third embodiment of the invention.

For furnaces which must be gas-tight, the embodiment shown in FIG. 4 is preferably used. This device corresponds essentially to the one shown in FIG. 2 but is additionally provided with a sealing plate 41 which, in combination with an underlying packing 42, is clamped between the holder 7 and the lead-through brick 6. The plate 41 has in its plane larger dimensions than the lead-through brick 6 and can be fixed sealingly to the roof casing surrounding the roof hole when being mounted onto the furnace. As further shown in FIG. 4, four holes 43 are situated at the corners of the plate, and fastening screws can be introduced therethrough. In order to seal the lead-through holes 44*a*, 44*b*, which are provided in the plate for the terminals 3*a*, 3*b*, sleeve rings 45*a*, 45*b* are used for pressing down a sealing cord 46*a*, 46*b* (Refrasil Cord) laid around each terminal 3*a*, 3*b* so as to seal against the cylindrical surface of the terminal and also against a shoulder 47*a*, 47*b* designed for this purpose in each of the holes 44*a*,44*b*.

I claim:

1. A holding device for electrical resistance elements (1) to be suspended in lead-through bricks (6) in furnaces, comprising a holder (7) having two opposed holding jaws (8,9) for securing the terminal portions (3*a*, 3*b*) of a said resistance element, said portions extending through holes in a said lead-through brick, said holder (7) being connected and braced to said lead-through brick by means of an anchoring device comprising an anchor member (14) secured to said lead-through brick (6) and a fastening member (13, 25) secured to said holding jaws (8, 9), said anchor and fastening members (13, 14) being removably connected to each other, and at least one of these members being movably mounted so as to permit adjustment of said anchoring device prior to the fastening of said holder (7) to said load-through brick (6).

2. A holding device according to claim 1, wherein said anchor member (14) and said fastening member (13, 25) are positively (21–23) connected to each other.

3. A holding device according to claim 2, wherein said anchor member comprises a pin (14) which is pivotably secured in a hole (15) in said lead-through brick, said pin having a certain clearance in said hole.

4. A holding device according to any one of claims 1 to 3, wherein said fastening member comprises a yoke (13) straddling a fastening member connecting said holding jaws, said yoke (13) having a clamp screw (25) engaged in a threaded hole (26) in the straddle portion (27) of said yoke, the end of said clamp screw abutting said connecting member (10).

5. A holding device according to claim 4, wherein said yoke (13) is displaceable along and/or rotatable about said connecting member (10).

6. A holding device according to claim 3, wherein the free end portion (19–21) of said pin (14) is positively connected (21–23) to the yoke portion (22–23) opposite said clamp screw (25).

7. A holding device according to claim 6, wherein the positive connection (21–23) of said pin (14) to said yoke (13) is secured by means of a clamp screw (25).

8. A holding device according to claim 1, comprising spacing and/or sealing members (34, 37, 38; 41, 42, 44–47) between said holder (7) and said lead-through brick (6).

9. A holding device according to claim 8, comprising a plate (41) and a packing (42), both with holes (44*a–c*) for said terminals (3) and said anchor member (14), disposed between said holder (7) and said lead-through brick (6).

10. A holding device according to claim 8 or 9, comprising sealing means (45–46) arranged in recesses made around the holes (44) which accommodate said terminals in said lead-through brick or said plate (41).

11. A holding device according to claim 10, wherein said sealing means comprise an annular washer or sleeve (45) and an annular gasket (46).

12. A holding device according to claim 8, comprising sleeves (34) forming spacing means and air nozzles and enclosing each of said terminals, and corresponding annular gaskets (37, 38) between said holder (7) and said lead-through brick (6) or said plate (41).

* * * * *